US011499243B2

(12) United States Patent
Jeong

(10) Patent No.: US 11,499,243 B2
(45) Date of Patent: Nov. 15, 2022

(54) METHOD FOR MANUFACTURING ALUMINUM ALLOY ANODIZED FILM HAVING SUPERHYDROPHOBIC SURFACE

(71) Applicant: DONG-EUI UNIVERSITY INDUSTRIAL-ACADEMIC COOPERATION FOUNDATION, Busan (KR)

(72) Inventor: Chanyoung Jeong, Busan (KR)

(73) Assignee: DONG-EUI UNIVERSITY INDUSTRIAL-ACADEMIC COOPERATION FOUNDATION, Busan (KR)

( * ) Notice: Subject to any disclaimer, the term of this patent is extended or adjusted under 35 U.S.C. 154(b) by 0 days.

(21) Appl. No.: 17/312,056

(22) PCT Filed: Nov. 8, 2019

(86) PCT No.: PCT/KR2019/015150
§ 371 (c)(1),
(2) Date: Jun. 9, 2021

(87) PCT Pub. No.: WO2020/141714
PCT Pub. Date: Jul. 9, 2020

(65) Prior Publication Data

US 2022/0025539 A1 Jan. 27, 2022

(30) Foreign Application Priority Data

Dec. 31, 2018 (KR) ..... 10-2018-0173967

(51) Int. Cl.
*C25D 11/24* (2006.01)
*C25D 11/12* (2006.01)
(Continued)

(52) U.S. Cl.
CPC ..... *C25D 11/24* (2013.01); *C25D 11/12* (2013.01); *C25D 11/16* (2013.01); *C25F 3/20* (2013.01)

(58) Field of Classification Search
None
See application file for complete search history.

(56) References Cited

U.S. PATENT DOCUMENTS

2009/0194914 A1* 8/2009 Uozu ..... B29C 33/38 264/494

FOREIGN PATENT DOCUMENTS

KR 10-2011-0074269 A 6/2011
KR 10-2011-0085094 A 7/2011
(Continued)

OTHER PUBLICATIONS

Yeong et al. (KR 20170033073A, machine translation) (Year: 2017).*

(Continued)

*Primary Examiner* — Wojciech Haske
(74) *Attorney, Agent, or Firm* — Sughrue Mion, PLLC

(57) ABSTRACT

The present invention relates to a method for manufacturing an aluminum alloy anodized film having a superhydrophobic surface and an aluminum alloy having an anodized film with a superhydrophobic surface manufactured by the method. The present invention has an economical effect that an aluminum alloy, in which a three-dimensional shaped anodized film structure formed on the surface thereof is controlled in various forms, such as a pillar-on-pore structure, may be manufactured at low costs within a short time. The aluminum alloy with the controlled anodized film structure has excellent superhydrophobicity, corrosion resistance, and thermal conductivity, and thus may be used in various industrial fields, such as electronic device housings,
(Continued)

LED lighting covers, heat exchangers, pipes, road structures, automobiles, aircrafts, ships, and generators.

4 Claims, 8 Drawing Sheets

(51) Int. Cl.
*C25D 11/16* (2006.01)
*C25F 3/20* (2006.01)

(56) References Cited

FOREIGN PATENT DOCUMENTS

KR 10-2015-0034009 A 4/2015
KR 10-2017-0033073 A 3/2017

OTHER PUBLICATIONS

Chanyoung Jeong et al., "Single-Step Direct Fabrication of Pillar-on-Pore Hybrid Nanostructures in Anodizing Aluminum for Superior Superhydrophobic Efficiency", ACS Applied Materials & Interfaces, 2012, 4, 842-848.
Hyejeong Ji et al, "Development of Superhydrophobic Aluminum Alloy (5052) by Stepwise Anodization Technique", Korean Institute of Surface Engineering Conference, 2018.
International search report for PCT/KR2019/015150 dated Feb. 21, 2020.

* cited by examiner

【FIG 1】
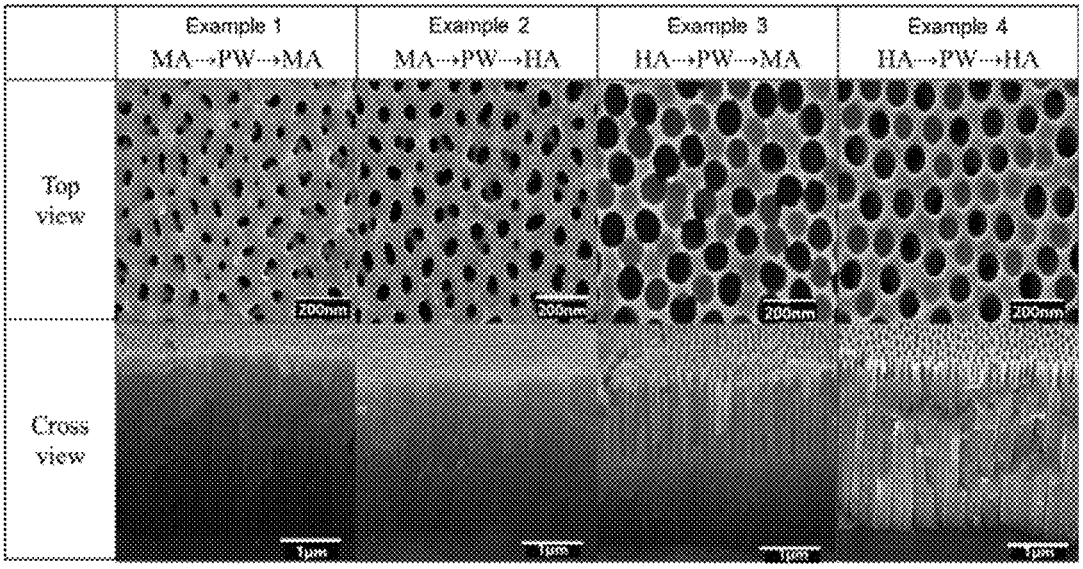

【FIG 2】
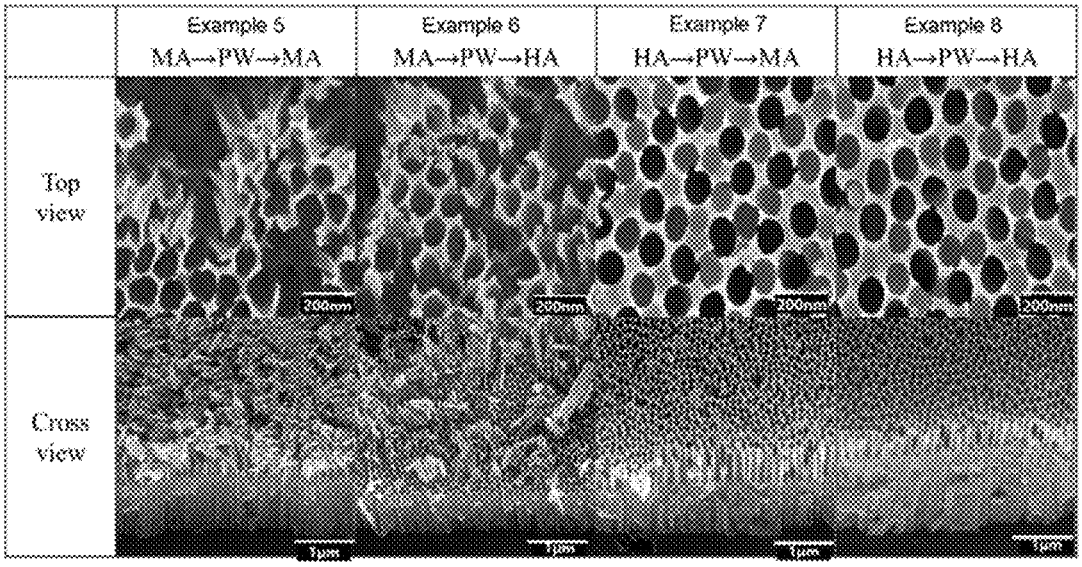

【FIG 3】
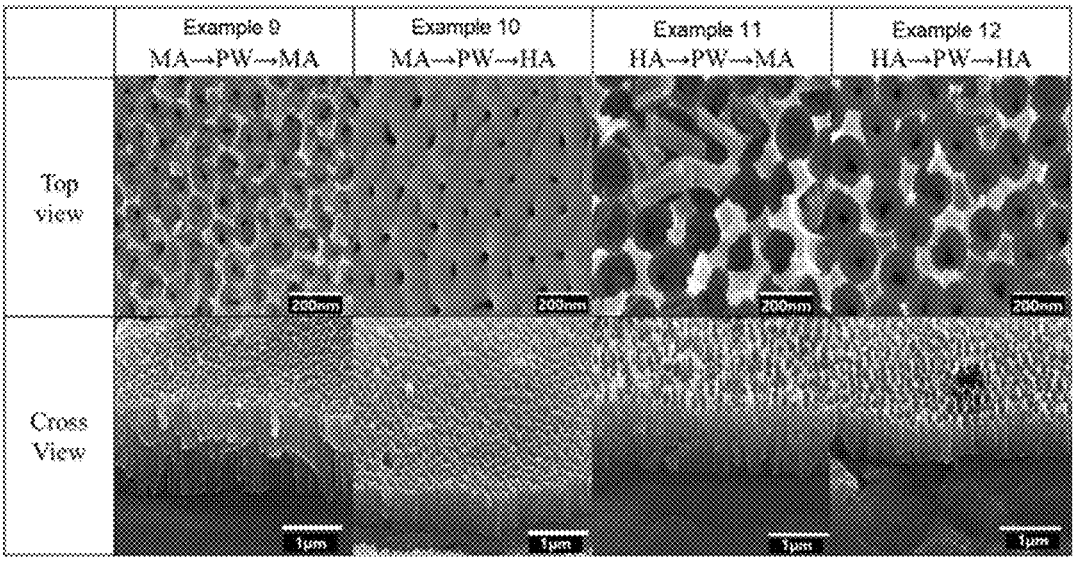

【FIG 4】
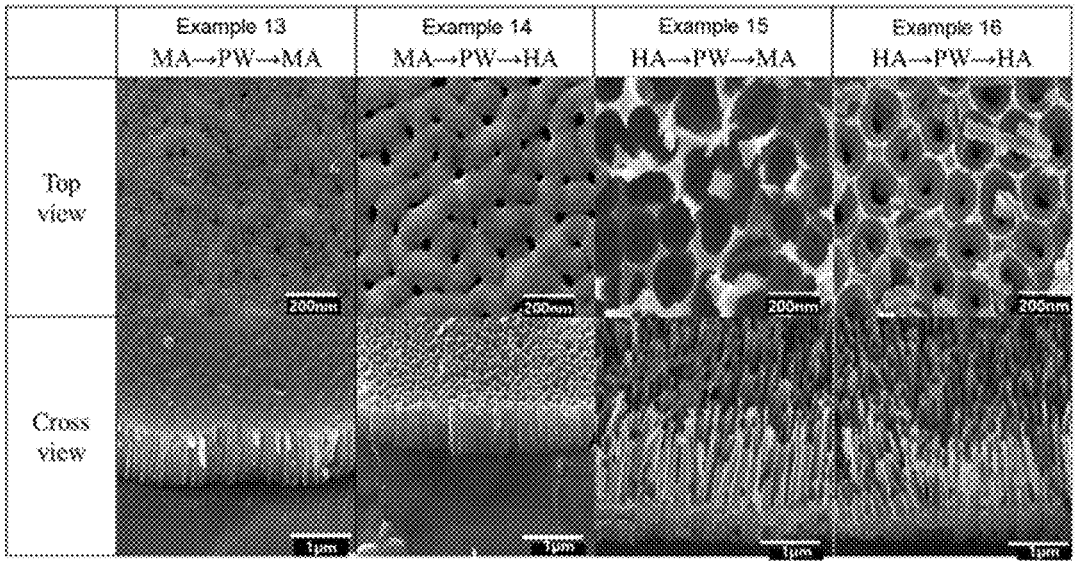

【FIG 5】
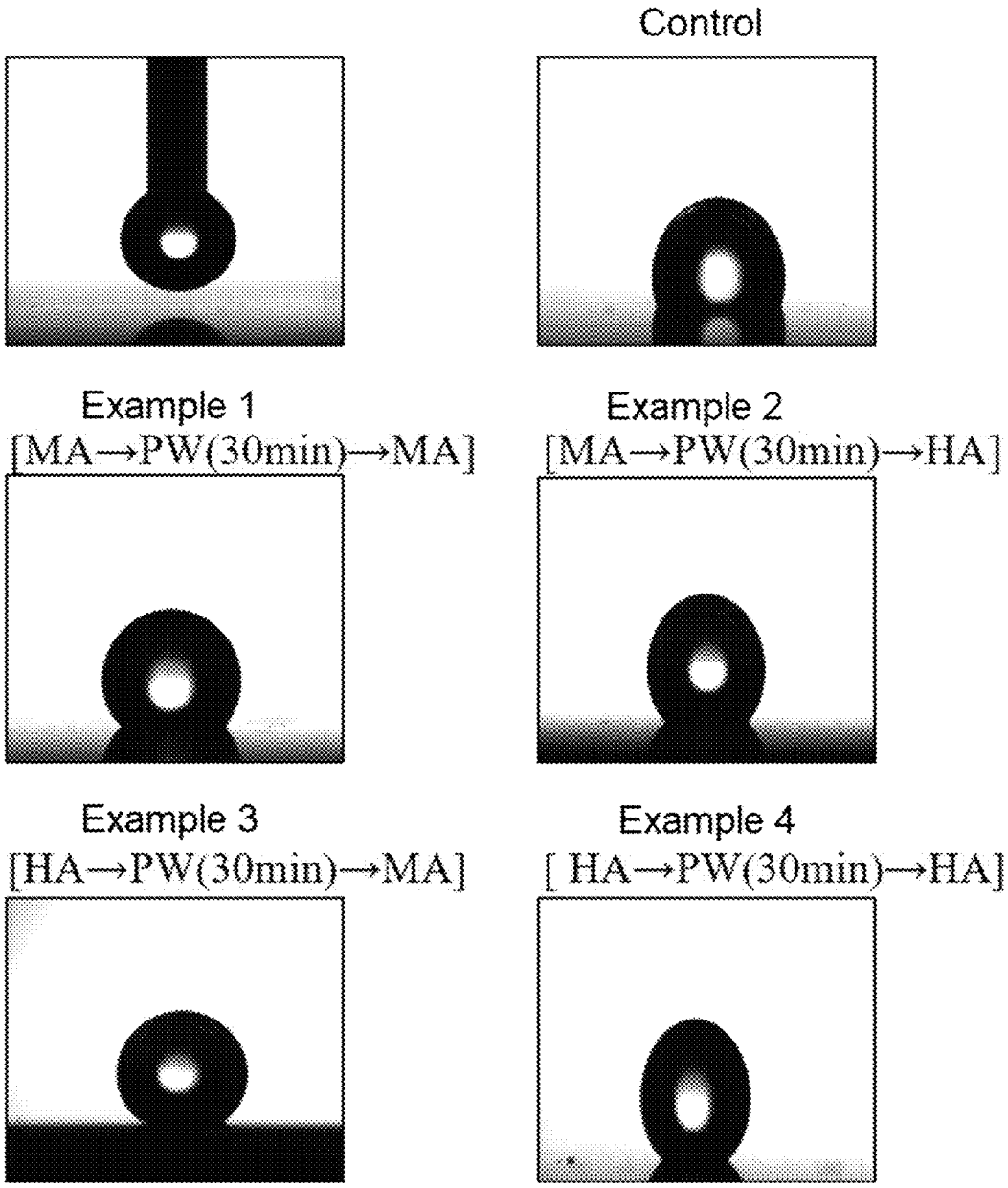

【FIG 6】
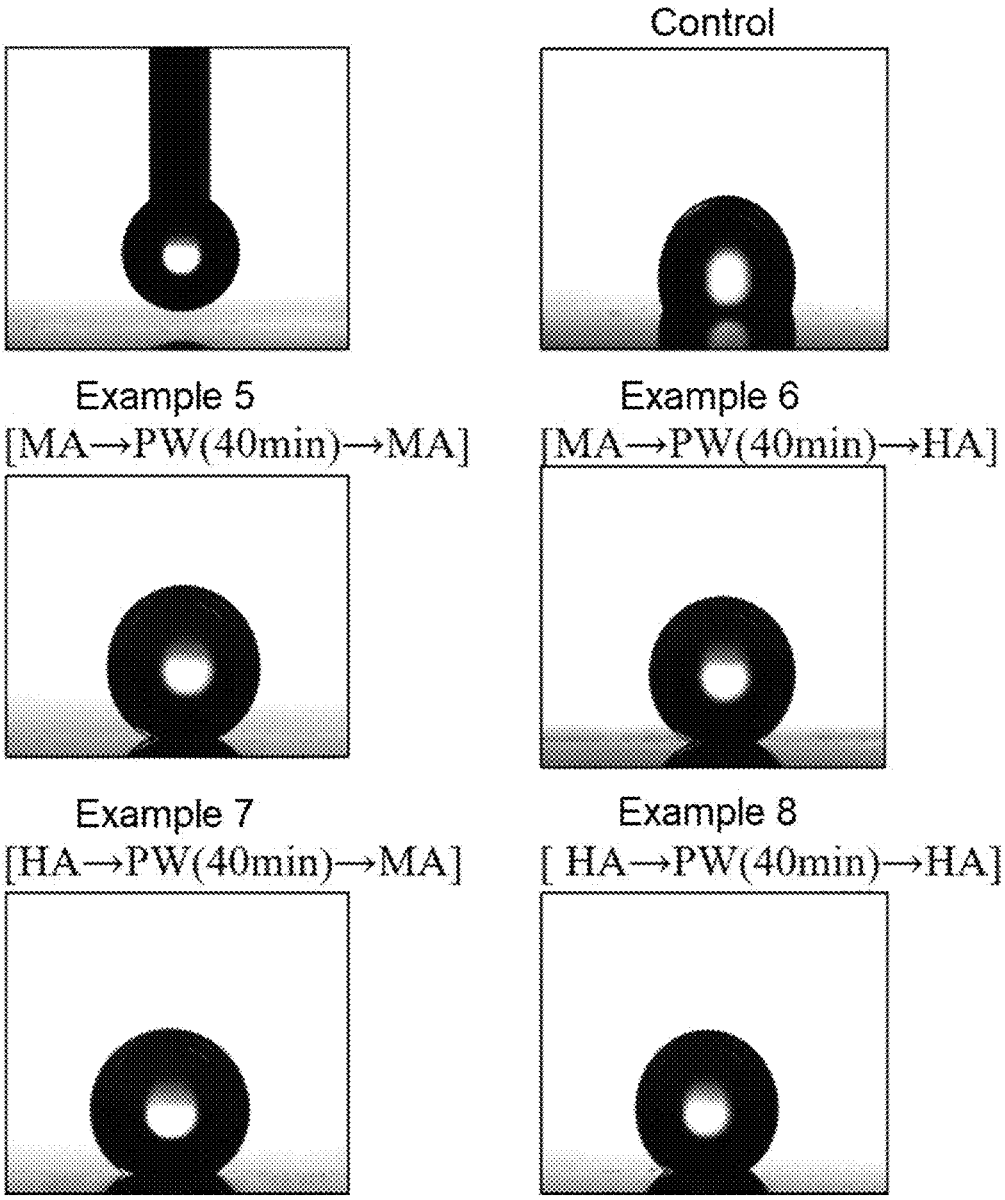

【FIG 7】
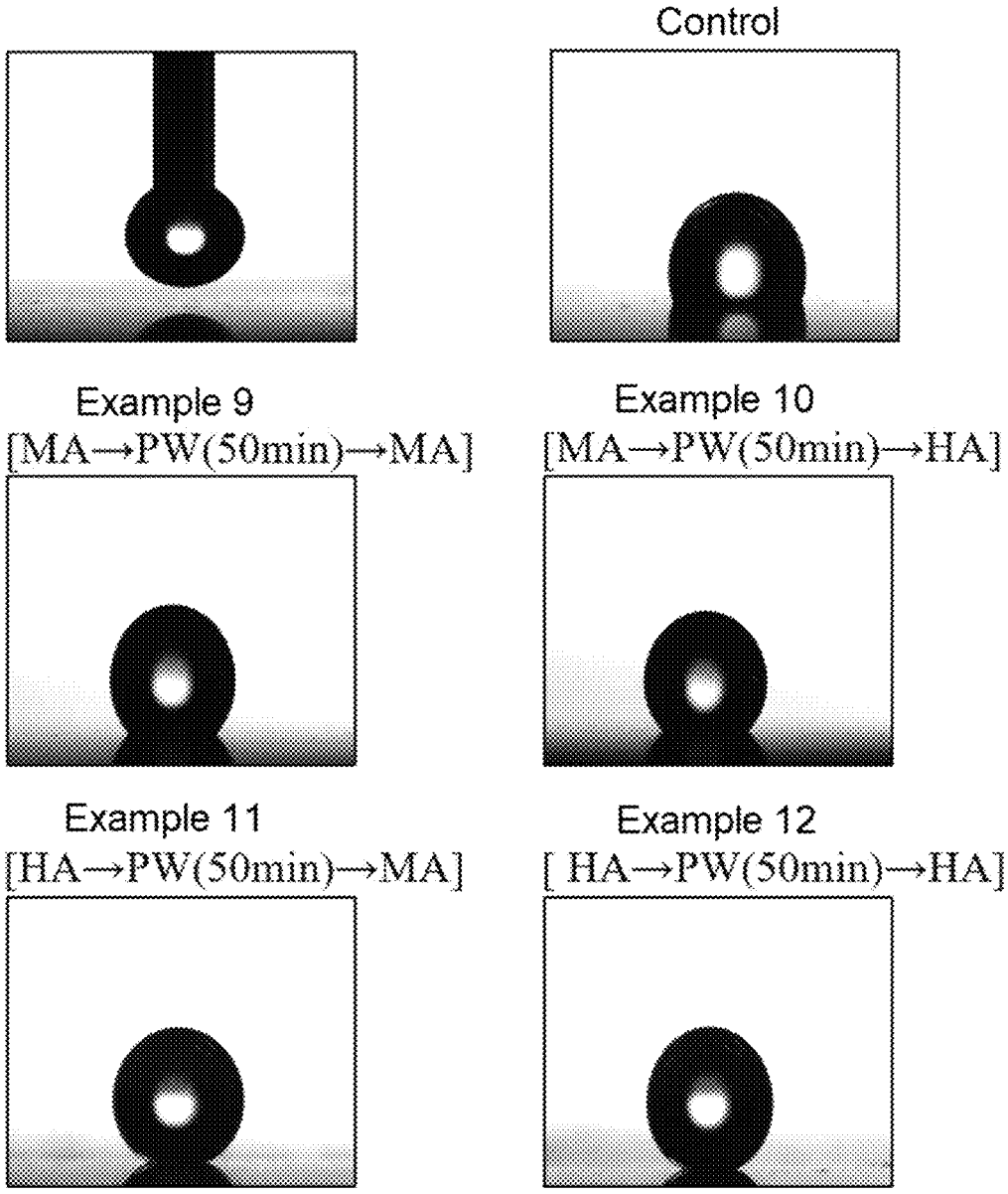

【FIG 8】
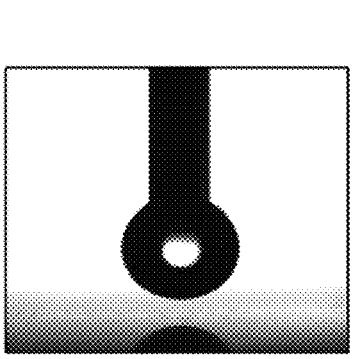
Control
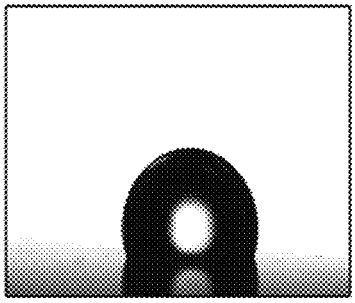
Example 13
[MA→PW(60min)→MA]
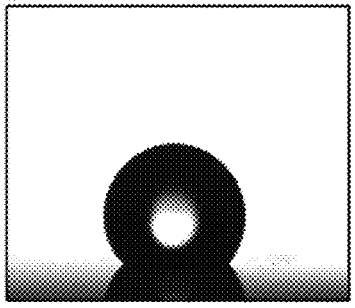
Example 14
[MA→PW(60min)→HA]
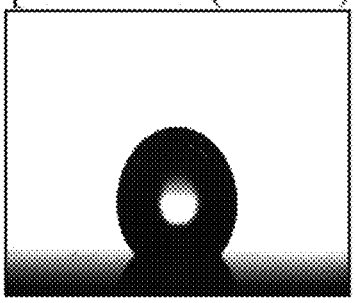
Example 15
[HA→PW(60min)→MA]
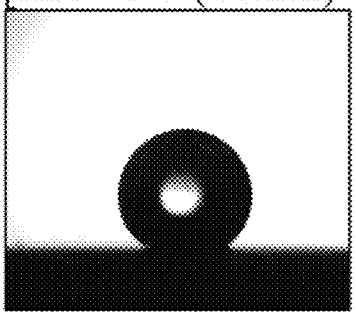
Example 16
[ HA→PW(60min)→HA]
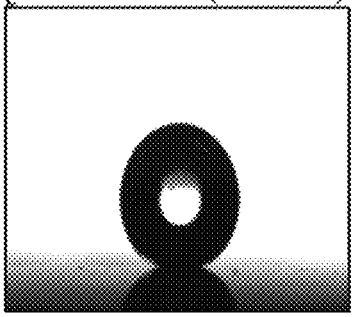

METHOD FOR MANUFACTURING ALUMINUM ALLOY ANODIZED FILM HAVING SUPERHYDROPHOBIC SURFACE

CROSS-REFERENCE TO RELATED APPLICATIONS

This application is a National Stage of International Application No. PCT/KR2019/015150 filed Nov. 8, 2019, which claims priority to Korea Patent Application No. KR 10-2018-0173967 filed on Dec. 31, 2018, the entire disclosures of which are incorporated herein by reference.

TECHNICAL FIELD

The present invention relates to a method for manufacturing an aluminum alloy anodized film having a superhydrophobic surface, and an aluminum alloy on which an anodized film having a superhydrophobic surface manufactured using the method is formed.

This research was supported by the MSIT (Ministry of Science and ICT), Korea, under the Grand Information Technology Research Center support program (IITP-2021-2020-0-01791) supervised by the IITP (Institute for Information & communications Technology Planning & Evaluation).

BACKGROUND ART

With a recent expanded range of applications since an aluminum oxide film having nano-sized pores arranged in a regular hexagonal structure was first studied and reported in 1995, the aluminum oxide film has been used in nanotechnology such as carbon nanotubes, nanowires or the like using an aluminum anodization process. In addition, various nanotechnology researches are actively being conducted.

The pore diameter ($D_P$) and the interpore distance ($D_{int}$) of the aluminum anodized film, as factors that are important in photoelectric elements such as solar cells, and LEDs, and nanotechnology such as metal nanowires, have a direct impact on the performance in related application fields and devices.

The electrochemical anodization process has been used in the surface treatment of metallic materials for more than 70 years. Nanostructures fabricated through the anodization process can implement nanostructures with less budget and time compared to expensive electronic lithography or semiconductor etching processes using silicon. However, this anodized film has a two-dimensional porous arrangement that enables only the side dimensions to be controlled.

Further, although a lot of research and techniques such as oxalic acid method, sulfuric acid method, and phosphoric acid method have been developed in the production of regularly arranged anodized aluminum films in which the type and concentration of an acid electrolyte of an aluminum alloy are adjusted, the anodization process has limitations in increasing the pore diameter and the interpore distance due to changes in the type and concentration of the acid electrolyte, and this technique is also possible only to produce a two-dimensional porous anodized film.

Meanwhile, the pillar-on-pore (POP) structure, i.e., a structure in which a sharp pillar is formed in a single or bundle form in the upper part of the pore, has a contact angle which is higher than that of an existing planar hexagonal porous surface and a contact angle hysteresis which is lower than that of the existing planar hexagonal porous surface, and has excellent superhydrophobic properties accordingly.

In addition, as the pillar-on-pore structure has properties such as hydrodynamic drag reduction, anticorrosion, and antibiofouling, anti-icing, it can play a big role in realizing the surface of smartphones, home appliances, or the like. However, although a technique for forming such a pillar-on-pore structure on a semiconductor or high-purity aluminum substrate has been studied, it is very difficult to form it on an alloy, and has not been studied yet. In general, although a lot of research have been done on the technology of manufacturing a structure having a three-dimensional shaped porous arrangement from an aluminum substrate with high purity, it is used in an alloy form rather than a high-purity aluminum substrate in the actual industry, and when the technology researched on the high-purity aluminum substrate is applied to an aluminum alloy used in actual commercialization, there is a problem that it is difficult to reproduce the same formation control.

Therefore, in order to solve the conventional problems as described above, and develop a method of controlling the fabrication of an aluminum film having a three-dimensional shaped porous arrangement and the formation of a structure, and a method of forming a pillar-on-pore structure on an alloy, the present applicant has completed the present invention by adjusting the anodization voltage on the pre-patterned aluminum alloy to perform the secondary and tertiary anodization processes, thereby producing a three-dimensional shaped porous film having various structures such as pillar-on-pores.

DISCLOSURE

Technical Problem

An object of the present invention is to provide a method for manufacturing an aluminum alloy anodized film having a superhydrophobic surface.

Another object of the present invention is to provide an aluminum alloy on which an anodized film having a superhydrophobic surface manufactured by the method is formed.

Still another object of the present invention is to provide a method for manufacturing an aluminum alloy anodized film having a superhydrophobic surface of a pillar-on-pore structure.

Still another object of the present invention is to provide an aluminum alloy on which an anodized film having a superhydrophobic surface of a pillar-on-pore structure manufactured by the method is formed.

Technical Solution

To achieve the foregoing objects, the present invention provides a method for manufacturing an aluminum alloy anodized film having a superhydrophobic surface, the method including: a pre-patterning step (step 1) of removing a primary anodized film by performing an etching process after primarily anodizing an aluminum alloy at 30 to 50 V for 5 to 15 hours; a step (step 2) of secondarily anodizing the aluminum alloy for which pre-patterning has been completed in the step 1; a step (step 3) of pore-widening the aluminum alloy which has been secondarily anodized in the step 2; and a step (step 4) of thirdly anodizing the aluminum alloy for which pore widening has been completed in the step 3, in which the secondary anodization of the step 2 and the tertiary anodization of the step 4 are each performed using any one condition of: a mild anodizing condition in which the anodization process is performed at 20 to 50 V for 10 to 50 minutes; and a hard anodizing condition in which the anodization process is performed at 60 to 90 V for 10 to 50 seconds.

Furthermore, the present invention provides an aluminum alloy on which an anodized film having a superhydrophobic surface manufactured by the method is formed.

Furthermore, the present invention provides a method for manufacturing an aluminum alloy anodized film having a superhydrophobic surface of a pillar-on-pore structure, the method including: a pre-patterning step (step 1) of removing a primary anodized film by performing an etching process after primarily anodizing an aluminum alloy at 30 to 50 V for 5 to 15 hours; a step (step 2) of secondarily anodizing the aluminum alloy for which pre-patterning has been completed in the step 1; a step (step 3) of pore-widening the aluminum alloy by immersing the aluminum alloy which has been secondarily anodized in the step 2 in a 0.01 to 10 M phosphoric acid ($H_3PO_4$) solution for 55 to 65 minutes; and a step (step 4) of thirdly anodizing the aluminum alloy for which pore widening has been completed in the step 3, in which the secondary anodization of the step 2 and the tertiary anodization of the step 4 are each performed using a hard anodizing condition in which the anodization process is performed at 70 to 90 V for 20 to 40 seconds.

Furthermore, the present invention provides an aluminum alloy on which an anodized film having a superhydrophobic surface of a pillar-on-pore structure manufactured by the method is formed.

Advantageous Effects

A method for manufacturing an aluminum alloy anodized film having a superhydrophobic surface according to the present invention has an economic effect of enabling an aluminum alloy with a controlled three-dimensional shaped anodized film structure to be manufactured at low cost in a short time by adjusting the anodization voltage and time, thereby allowing the pore shape, diameter, and density of an anodic aluminum oxide layer formed on the aluminum alloy surface to be implemented in various forms such as pillar-on-pore, and as the aluminum alloy with a controlled anodized film structure manufactured by the method is excellent in superhydrophobicity, corrosion resistance, and thermal conductivity, it may be used in various industrial fields including electronic device housings, LED lighting covers, heat exchangers, pipes, road structures, automobiles, aircrafts, ships, generators, etc.

DESCRIPTION OF DRAWINGS

FIG. 1 is scanning electron microscope (SEM) images photographing three-dimensional structures of the surface (top view) and the cross section (cross view) of an aluminum alloy anodized film formed on the surfaces of pre-patterned aluminum alloys of Examples 1 to 4 according to the present invention; at this time, MA is carried out at 40 V for 30 minutes, HA is carried out at 80 V for 30 seconds, and PW is carried out at 30° C. for 30 minutes, and the scale bars of the surface and cross section are 200 nm and 1 μm respectively.

FIG. 2 is scanning electron microscope (SEM) images photographing three-dimensional structures of the surface (top view) and the cross section (cross view) of an aluminum alloy anodized film formed on the surfaces of pre-patterned aluminum alloys of Examples 5 to 8 according to the present invention; at this time, MA is carried out at 40 V for 30 minutes, HA is carried out at 80 V for 30 seconds, and PW is carried out at 30° C. for 40 minutes, and the scale bars of the surface and cross section are 200 nm and 1 μm respectively.

FIG. 3 is scanning electron microscope (SEM) images photographing three-dimensional structures of the surface (top view) and the cross section (cross view) of an aluminum alloy anodized film formed on the surfaces of pre-patterned aluminum alloys of Examples 9 to 12 according to the present invention; at this time, MA is carried out at 40 V for 30 minutes, HA is carried out at 80 V for 30 seconds, and PW is carried out at 30° C. for 50 minutes, and the scale bars of the surface and cross section are 200 nm and 1 μm respectively.

FIG. 4 is scanning electron microscope (SEM) images photographing three-dimensional structures of the surface (top view) and the cross section (cross view) of an aluminum alloy anodized film formed on the surfaces of pre-patterned aluminum alloys of Examples 13 to 16 according to the present invention; at this time, MA is carried out at 40 V for 30 minutes, HA is carried out at 80 V for 30 seconds, and PW is carried out at 30° C. for 60 minutes, and the scale bars of the surface and cross section are 200 nm and 1 μm respectively.

FIG. 5 is images showing results of measuring contact angles with respect to water droplets after coating FDTS on an aluminum alloy anodized film formed on the surfaces of pre-patterned aluminum alloys of Examples 1 to 4 according to the present invention.

FIG. 6 is images showing results of measuring contact angles with respect to water droplets after coating FDTS on an aluminum alloy anodized film formed on the surfaces of pre-patterned aluminum alloys of Examples 5 to 8 according to the present invention.

FIG. 7 is images showing results of measuring contact angles with respect to water droplets after coating FDTS on an aluminum alloy anodized film formed on the surfaces of pre-patterned aluminum alloys of Examples 9 to 12 according to the present invention.

FIG. 8 is images showing results of measuring contact angles with respect to water droplets after coating FDTS on an aluminum alloy anodized film formed on the surfaces of pre-patterned aluminum alloys of Examples 13 to 16 according to the present invention.

MODES OF THE INVENTION

Hereinafter, the present invention will be described in detail.

Method for Manufacturing Aluminum Alloy Anodized Film Having Superhydrophobic Surface The present invention provides a method for manufacturing an aluminum alloy anodized film having a superhydrophobic surface, the method including:

a pre-patterning step (step 1) of removing a primary anodized film by performing an etching process after primarily anodizing an aluminum alloy at 30 to 50 V for 5 to 15 hours;

a step (step 2) of secondarily anodizing the aluminum alloy for which pre-patterning has been completed in the step 1;

a step (step 3) of pore-widening the aluminum alloy which has been secondarily anodized in the step 2; and a step (step 4) of thirdly anodizing the aluminum alloy for which pore widening has been completed in the step 3, in which the secondary anodization of the step 2 and the tertiary anodization of the step 4 are each performed using any one condition of: a mild anodizing condition in which the anodization process is performed at 20 to 50 V for 10 to 50 minutes; and a hard anodizing condition in which the anodization process is performed at 60 to 90 V for 10 to 50 seconds.

In general, when water droplets come into contact with a solid surface, the solid surface is defined as hydrophobic if the contact angle of the water droplets corresponds to a range of 120 to 150°, the solid surface is defined as superhydrophobic if the contact angle is 150° or more, and the solid surface is defined as ultra-superhydrophobic if the contact angle is 170° or more.

In a method for manufacturing an aluminum alloy anodized film having a superhydrophobic surface according to the present invention, the pore widening of the step 3 may be immersing the secondarily anodized aluminum alloy of the step 2 in a 0.01 to 10 M phosphoric acid ($H_3PO_4$) solution for 20 to 70 minutes. The pore widening of the step 3 may be immersing the secondarily anodized aluminum alloy of the step 2 preferably in a 0.01 to 1.0 M phosphoric acid solution for 45 to 65 minutes, more preferably in a 0.05 to 0.5 M phosphoric acid solution for 55 to 65 minutes, and even more preferably in a 0.08 to 0.2 M phosphoric acid solution for 58 to 62 minutes.

In a method for manufacturing an aluminum alloy anodized film having a superhydrophobic surface according to the present invention, a secondary anodic aluminum oxide layer may be formed by the secondary anodization, and a third anodic aluminum oxide layer may be formed by the tertiary anodization. At this time, the region of the secondary anodic aluminum oxide layer formed by the secondary anodization may be formed on the outer side far from the surface of the aluminum alloy, and the region of the third anodic aluminum oxide layer formed by the tertiary anodization may be formed on the inner side close to the surface of the aluminum alloy.

According to an example of the present invention, the secondary anodization of the step 2 may be a hard anodizing process performed at 70 to 90 V for 20 to 40 seconds, the pore widening of the step 3 may be an immersing process performed in a 0.01 to 10 M phosphoric acid ($H_3PO_4$) solution for 45 to 65 minutes, and the tertiary anodization of the step 4 may be a hard anodizing process performed at 70 to 90 V for 20 to 40 seconds, preferably, the secondary anodization of the step 2 may be a hard anodizing process performed at 70 to 90 V for 20 to 40 seconds, the pore widening of the step 3 may be an immersing process performed in the 0.01 to 10 M phosphoric acid ($H_3PO_4$) solution for 55 to 65 minutes, and the tertiary anodization of the step 4 may be a hard anodizing process performed at 70 to 90 V for 20 to 40 seconds, more preferably, the secondary anodization of the step 2 may be a hard anodizing process performed at 75 to 85 V for 25 to 35 seconds, the pore widening of the step 3 may be an immersing process performed in a 0.05 to 1.0 M phosphoric acid ($H_3PO_4$) solution for 55 to 65 minutes, and the tertiary anodization of the step 4 may be a hard anodizing process performed at 75 to 85 V for 25 to 35 seconds, even more preferably, the secondary anodization of the step 2 may be a hard anodizing process performed at 78 to 82 V for 28 to 32 seconds, the pore widening of the step 3 may be an immersing process performed in a 0.05 to 0.5 M phosphoric acid ($H_3PO_4$) solution for 28 to 32 minutes, and the tertiary anodization of the step 4 may be a hard anodizing process performed at 78 to 82 V for 28 to 32 seconds.

The aluminum alloy anodized film having a superhydrophobic surface according to the present invention may have a pillar-on-pore structure on the surface thereof.

In a method for manufacturing an aluminum alloy anodized film having a superhydrophobic surface according to the present invention, superhydrophobicity may be expressed by controlling one or more of the pore diameter and the interpore distance of a three-dimensional shaped anodic aluminum oxide layer formed on the surface of the aluminum alloy.

In a method for manufacturing an aluminum alloy anodized film having a superhydrophobic surface according to the present invention, the control of an anodized film structure on the aluminum alloy surface may be a process of controlling the anodized film structure to a hierarchical structure in which the pore diameter of a secondary anodic aluminum oxide layer is larger than that of a tertiary anodic aluminum oxide layer.

In a method for manufacturing an aluminum alloy anodized film having a superhydrophobic surface according to the present invention, electrolytes in which the primary anodization of the step 1, the secondary anodization of the step 2, and the tertiary anodization of the step 3 are performed may be each any one of sulfuric acid ($H_2SO_4$), phosphoric acid ($H_3PO_4$), oxalic acid ($C2H_2O_4$), chromic acid, hydrofluoric acid, dipotassium phosphate ($K_2HPO_4$), or mixed solutions thereof, and the electrolytes may be formed by using a material on which a metal to be anodized is formed as a working electrode in an oxidation treatment reactor containing the electrolytes and attaching the anode to the material on which the metal to be anodized is formed as the working electrode, and then using a platinum (Pt) or carbon electrode as a counter electrode and attaching the cathode to the platinum or carbon electrode as the counter electrode, thereby oxidizing the material on which the metal to be anodized is formed. Preferably, the electrolytes may be formed at a temperature of −5 to 10° C. using 0.1 to 0.5 M oxalic acid as the electrolytes, more preferably at a temperature of −2 to 2° C. using 0.2 to 0.4 M oxalic acid as the electrolytes.

The aluminum alloy that can be used in the present invention is preferably 5000 series aluminum alloys such as Al—Mg-based aluminum alloys. The 5000 series aluminum alloys may be one or more selected from the group consisting of Al 5005, Al 5023, Al 5042, Al 5052, Al 5054, Al 5056, Al 5082, Al 5083, Al 5084, Al 5086, Al 5154, Al 5182, Al 5252, Al 5352, Al 5383, Al 5454, Al 5456, Al 5457, Al 5657, and Al 5754.

Aluminum Alloy on Which Anodized Film Having Superhydrophobic Surface is Formed

Furthermore, the present invention provides an aluminum alloy on which an anodized film having a superhydrophobic surface manufactured by the method for manufacturing an aluminum alloy anodized film having a superhydrophobic surface is formed.

The aluminum alloy according to the present invention may have a three-dimensional shaped anodic aluminum oxide layer formed on the surface thereof.

Method for Manufacturing Aluminum Alloy Anodized Film Having Superhydrophobic Surface of Pillar-on-Pore Structure Furthermore, the present invention provides a method for manufacturing an aluminum alloy anodized film having a superhydrophobic surface of a pillar-on-pore structure, the method including: a pre-patterning step (step 1) of removing a primary anodized film by performing an etching process after primarily anodizing an aluminum alloy at 30 to 50 V for 5 to 15 hours; a step (step 2) of secondarily anodizing the aluminum alloy for which pre-patterning has been completed in the step 1; a step (step 3) of pore-widening the aluminum alloy by immersing the aluminum alloy which has been secondarily anodized in the step 2 in a 0.01 to 10 M phosphoric acid ($H_3PO_4$) solution for 45 to 65 minutes; and a step (step 4) of thirdly anodizing the aluminum alloy for which pore widening has been completed in the step 3, in which the secondary anodization of the step 2 and the tertiary anodization of the step 4 are each performed using a hard anodizing condition in which the anodization process is performed at 70 to 90 V for 20 to 40 seconds.

In a method for manufacturing an aluminum alloy anodized film having a superhydrophobic surface of a pillar-on-pore structure according to the present invention, the secondary anodization of the step 2 and the tertiary anodization of the step 4 may be each performed using a hard anodizing condition in which the anodization process is performed at 75 to 85 V for 25 to 35 seconds, and the pore widening of the step 3 may be immersing the secondarily anodized aluminum alloy of the step 2 in a 0.05 to 1.0 M phosphoric acid ($H_3PO_4$) solution for 55 to 65 minutes, and preferably, the secondary anodization of the step 2 and the tertiary anodization of the step 4 may be each performed using a hard anodizing condition in which the anodization process is performed at 78 to 82 V for 28 to 32 seconds, and the pore widening of the step 3 may be immersing the secondarily anodized aluminum alloy of the step 2 in a 0.05 to 0.5 M phosphoric acid ($H_3PO_4$) solution for 58 to 62 minutes.

In a method for manufacturing an aluminum alloy anodized film having a superhydrophobic surface of a pillar-on-pore structure according to the present invention, a secondary anodic aluminum oxide layer may be formed by the secondary anodization, and a third anodic aluminum oxide layer may be formed by the tertiary anodization. At this time, the region of the secondary anodic aluminum oxide layer formed by the secondary anodization may be formed on the outer side far from the surface of the aluminum alloy, and the region of the third anodic aluminum oxide layer formed by the tertiary anodization may be formed on the inner side close to the surface of the aluminum alloy.

In a method for manufacturing an aluminum alloy anodized film having a superhydrophobic surface of a pillar-on-pore structure according to the present invention, excellent superhydrophobicity may be expressed by forming an anodic aluminum oxide layer of a pillar-on-pore structure on the surface of the aluminum alloy.

In a method for manufacturing an aluminum alloy anodized film having a superhydrophobic surface of a pillar-on-pore structure according to the present invention, electrolytes in which the primary anodization of the step 1, the secondary anodization of the step 2, and the tertiary anodization of the step 3 are performed may be each any one of sulfuric acid ($H_2SO_4$), phosphoric acid ($H_3PO_4$), oxalic acid ($C_2H_2O_4$), chromic acid, hydrofluoric acid, dipotassium phosphate ($K_2HPO_4$), or mixed solutions thereof, and the electrolytes may be formed by using a material on which a metal to be anodized is formed as a working electrode in an oxidation treatment reactor containing the electrolytes and attaching the anode to the material on which the metal to be anodized is formed as the working electrode, and then using a platinum (Pt) or carbon electrode as a counter electrode and attaching the cathode to the platinum or carbon electrode as the counter electrode, thereby oxidizing the material on which the metal to be anodized is formed. Preferably, the electrolytes may be formed at a temperature of −5 to 10° C. using 0.1 to 0.5 M oxalic acid as the electrolytes, more preferably at a temperature of −2 to 2° C. using 0.2 to 0.4 M oxalic acid as the electrolytes.

In a method for manufacturing an aluminum alloy anodized film having a superhydrophobic surface of a pillar-on-pore structure according to the present invention, the aluminum alloy is preferably 5000 series aluminum alloys such as Al—Mg-based aluminum alloys. The 5000 series aluminum alloys may be one or more selected from the group consisting of Al 5005, Al 5023, Al 5042, Al 5052, Al 5054, Al 5056, Al 5082, Al 5083, Al 5084, Al 5086, Al 5154, Al 5182, Al 5252, Al 5352, Al 5383, Al 5454, Al 5456, Al 5457, Al 5657, and Al 5754.

A method for manufacturing an aluminum alloy anodized film having a superhydrophobic surface of a pillar-on-pore structure according to the present invention has an economic effect of enabling a POP-type anodized film to be produced on the surface of an aluminum alloy in a short time at low cost.

Aluminum Alloy on Which Anodized Film Having Superhydrophobic Surface of Pillar-on-Pore Structure is Formed Furthermore, the present invention provides an aluminum alloy on which an anodized film having a superhydrophobic surface of a pillar-on-pore structure manufactured by the method for manufacturing an aluminum alloy anodized film having a superhydrophobic surface of a pillar-on-pore structure is formed.

It has been confirmed in the present invention that the aluminum alloy on which the anodized film having the superhydrophobic surface of the pillar-on-pore structure according to the present invention is formed has very low wettability to water and excellent superhydrophobicity (super water repellency) (refer to Experimental Example 2).

Mode for Carrying Out the Invention

Hereinafter, the present invention will be described in more detail by the following example. However, the following example is merely illustrative of the present invention, and the contents of the present invention are not limited by the following example.

<Example> Manufacturing of Aluminum Alloy Anodized Films

In order to manufacture an aluminum alloy anodized film, pre-patterning, pore widening (PW), and voltage modulation were performed using an aluminum 5052 alloy. Component information of the aluminum 5052 alloy (Al 5052, size 20×30 mm) is as follows: 2.2 to 2.8% of Mg, 0.25% of Si, 0.40% of Fe, 0.10% of Cu, 0.10% of Mn, 1.0% of Zn, 0.15 to 0.35% of Cr, and the balance of Al.

Step 1: Pre-Patterning Process Through Primary anodization and Chemical Etching An aluminum 5052 alloy (Alcoa INC, USA) was used as a 5000 series aluminum (Al) alloy plate for manufacturing an anodized film, and the aluminum 5052 alloy was cleaned by sonicating the aluminum 5052 alloy in acetone and ethanol for 10 minutes in order to remove impurities on the surface of the aluminum 5052 alloy. The aluminum 5052 alloy was electrolytically polished for 1 minute by putting the aluminum 5052 alloy that had been ultrasonically cleaned to obtain the surface roughness in a mixed solution of ethanol and perchloric acid (Junsei, $C_2H_5OH:HC10_4$=4:1 (v/v)), and applying a voltage of 20 V to the aluminum 5052 alloy put in the mixed solution at room temperature (20° C.).

It was confirmed that the surface thereof became flat as the surface of the electrolytic polishing-completed aluminum alloy was well reflected.

A primary anodization was performed by using the electrolytically polished aluminum 5052 alloy (thickness 1 mm, size 20×30 mm) as a working electrode and using a platinum (Pt) electrode as a cathode, and maintaining a constant distance between poles as 5 cm intervals between the two electrodes. In the primary anodization, 0.3 M oxalic acid was used as an electrolyte, and the primary anodization was performed while keeping the electrolyte temperature constant at 0° C. using a double beaker. In order to suppress the disturbance of stable oxide growth due to the local temperature increase, the stirring process was carried out at a constant speed, and an alumina layer was grown by applying a voltage of 40 V using a constant voltage method, thereby performing the primary anodization process for 6 hours.

A pre-patterning process was performed by immersing the alumina layer that had grown through the primary anodization process in a mixed solution of chromic acid (1.8 wt %) and phosphoric acid (6 wt %) at 65° C. for 10 hours, thereby etching the grown alumina layer to remove the grown alumina layer.

Step 2-4: Secondary and Tertiary Anodization and Pore Widening Processes

Specifically, in order to obtain a desired film structure on the surface of the aluminum 5052 alloy, secondary anodization, pore widening, and tertiary anodization were performed after the pre-pattering had been completed.

Specifically, secondary and tertiary anodization processes of Examples were performed under the same acid electrolyte conditions as the primary anodization process of the step 1, and the anodization was performed by selectively adjusting the magnitude and sequence of voltages applied during the secondary anodization and tertiary anodization using two techniques of mild anodization (MA) using a relatively low voltage of 40 V or hard anodization (HA) using a high voltage of 80 V. At this time, the mild anodization was performed at 40 V for 30 minutes, and the hard anodization was performed at 80 V for 30 seconds. Meanwhile, in the secondary and tertiary anodization processes of Comparative Examples, anodization was performed using super hard anodization (SA) conditions of voltages and times as shown in Table 1 below.

In addition, an aluminum anodized film was grown by performing the tertiary anodization after performing a pore widening (PW) process of immersing the alumina layer that had grown through the secondary anodization in a 0.1 M phosphoric acid solution of 30° C. for 30 to 60 minutes before carrying out the tertiary anodization.

Aluminum alloy anodized films of Examples 1 to 4 in which the structural shape of the surface of the aluminum 5052 alloy was controlled were obtained by carrying out the secondary anodization (step 2), pore widening (step 3), and tertiary anodization (step 4) processes under the conditions shown in Table 1 below.

TABLE 1

| | Whether or not to perform pre-patterning (Step 1) | Process modes (Steps 2 to 4) | Secondary anodization (Step 2) Voltage (V) | Secondary anodization (Step 2) Time (min) | Pore widening (Step 3) Time (min) | Tertiary anodization (Step 4) Voltage (V) | Tertiary anodization (Step 4) Time (min) |
|---|---|---|---|---|---|---|---|
| Example 1 | Perform | MA→PW→MA | 40 | 30 | 30 | 40 | 30 |
| Example 2 | Perform | MA→PW→HA | 40 | 30 | 30 | 80 | 0.5 |
| Example 3 | Perform | HA→PW→MA | 80 | 0.5 | 30 | 40 | 30 |
| Example 4 | Perform | HA→PW→HA | 80 | 0.5 | 30 | 80 | 0.5 |
| Example 5 | Perform | MA→PW→MA | 40 | 30 | 40 | 40 | 30 |
| Example 6 | Perform | MA→PW→HA | 40 | 30 | 40 | 80 | 0.5 |
| Example 7 | Perform | HA→PW→MA | 80 | 0.5 | 40 | 40 | 30 |
| Example 8 | Perform | HA→PW→HA | 80 | 0.5 | 40 | 80 | 0.5 |
| Example 9 | Perform | MA→PW→MA | 40 | 30 | 50 | 40 | 30 |
| Example 10 | Perform | MA→PW→HA | 40 | 30 | 50 | 80 | 0.5 |
| Example 11 | Perform | HA→PW→MA | 80 | 0.5 | 50 | 40 | 30 |
| Example 12 | Perform | HA→PW→HA | 80 | 0.5 | 50 | 80 | 0.5 |
| Example 13 | Perform | MA→PW→MA | 40 | 30 | 60 | 40 | 30 |
| Example 14 | Perform | MA→PW→HA | 40 | 30 | 60 | 80 | 0.5 |
| Example 15 | Perform | HA→PW→MA | 80 | 0.5 | 60 | 40 | 30 |
| Example 16 | Perform | HA→PW→HA | 80 | 0.5 | 60 | 80 | 0.5 |
| Comparative Example 1 | Perform | SA→PW→SA | 100 | 0.5 | 30 | 100 | 0.5 |
| Comparative Example 2 | Perform | SA→PW→SA | 100 | 5 sec | 30 | 100 | 5 sec |
| Comparative Example 3 | Perform | SA→PW→SA | 120 | 0.5 | 30 | 120 | 0.5 |
| Comparative Example 4 | Perform | SA→PW→SA | 120 | 4 sec | 30 | 120 | 4 sec |

<Experimental Example 1> Analysis of Structural Characteristics of Aluminum Alloy Anodized Film According to Secondary and Tertiary Anodic Oxidation Conditions (Voltage and Time) and Pore Widening Time As shown in Table 1 above, surfaces and cross-sectional shapes of porous aluminum alloy anodized films of Examples 1 to 16 manufactured by performing various modes of MA→PW→MA, MA→PW→HA, HA→PW→HA and HA→PW→MA and varying the pore widening time were observed using a field-emission emission scanning electron microscope (FE-SEM) system (AURIGA® small dual-beam[81] FIB-SEM, Zeiss).

Each of the aluminum alloy anodized film specimens was cut into small pieces, fixed onto a stage with a carbon tape, coated with gold (Au) for 15 seconds by sputtering, and then imaged with a scanning electron microscope (SEM). At this time, the surfaces and cross-sectional structures of the aluminum alloy anodized films are observed as shown in FIGS. 1 to 4 by bending the film specimens to 90°, thereby generating parallel cracks.

FIGS. 1 to 4 are each scanning electron microscope (SEM) images photographing three-dimensional structures of the surface (top view) and the cross section (cross view) of an aluminum alloy anodized film formed on the surfaces of pre-patterned aluminum alloys of Examples 1 to 4, 5 to 8, 9 to 12, and 13 to 16 according to the present invention; at this time, MA is carried out at 40 V for 30 minutes, HA is carried out at 80 V for 30 seconds, and PW is carried out at 30° C. for 30 to 60 minutes, and the scale bars of the surface and cross section are 200 nm and 1 μm respectively.

As shown in FIGS. 1 to 4, although results of increasing diameters of pores in the secondary anodization regions of the aluminum alloy anodized films by the PW process were found in most cases, structures of the tertiary anodization regions were not affected. Accordingly, since sizes of the pores in the secondary anodization regions and the tertiary anodization regions are different in all of Examples 1 to 16, the criteria for the secondary and tertiary anodization regions may be classified by the size transition of the pores.

In addition, it was found that the voltage type of an anodized film including HA had larger pore diameter and interpore distance than the voltage type of an anodized film including MA. It is confirmed from these results that the magnitude of the anodization voltage may affect the size of the pores.

Meanwhile, as shown in FIGS. 3 and 4, it was confirmed that, in the case of Examples 12 and 16 manufactured by performing PW in the HA→PW→HA mode for 50 minutes or 60 minutes, pores of an aligned straight structure were formed in the tertiary anodization regions of the lower part in the cross section (cross view) images, and tip-like structures were formed in the secondary anodization regions on the straight pores. It was found that, a white (light gray) anodic oxide was formed next to the pores appearing in black in the surface (top view) images, and the corresponding part was confirmed to be a tip-like structure part formed in the secondary anodization regions.

Therefore, it was confirmed that anodized films of a structure having a pillar-on-pore shape in which bundle-shaped pillars were formed on the pore structure were manufactured in Examples 12 and 16 unlike other Examples, and it was confirmed that a much clearer pillar-on-pore shape was displayed particularly when manufacturing the anodized films under the conditions of Example 16.

As a result, it is confirmed that secondary and tertiary anodization voltage magnitudes, which are parameters, not only may control the pore diameter and the interpore distance, but also may control the growth of a three-dimensional shaped aluminum anodized film by directly affecting the size of the pores. In particular, it is confirmed that the condition of HA (80 V, 30 sec)→PW (60 min)→HA (80 V, 30 sec) of Example 16 is a condition under which an anodized film of the most clear POP structure can be manufactured.

<Experimental Example 2> Analysis of Water Repellent Properties of Aluminum Alloy Anodized Films According to Secondary and Tertiary Anodization Conditions (Voltage and Time) and Pore Widening Time In order to confirm the effect of structure forms of aluminum alloy anodized films on the water repellent properties, the wettability to water was evaluated after coating a self-assembled monolayer (SAM) of each of the porous aluminum alloy anodized films of Examples 1 to 16 with 1 H, 1 H, 2 H and 2 H-perfluorodecyltrichlorosilane (FDTS), i.e., coating materials with low surface energy, for 24 hours in a vacuum chamber, thereby implementing a surface with hydrophobicity.

In order to evaluate the wettability of the surfaces of porous aluminum alloy anodized film structures of Examples 1 to 4 of which surfaces were coated with FDTS, a contact angle measurement method was used to measure and analyze contact angles of 3 μl of deionized water droplets at room temperature. Moreover, contact angles were measured by the same method using the surfaces of non-anodized aluminum alloys coated with FDTS as a control group. An average value was calculated by measuring contact angles at different places for each specimen at least five times, and the results are shown in Table 2 below and FIGS. 5 to 8.

FIGS. 5 to 8 are respective images showing results of measuring contact angles for water droplets after coating FDTS on the aluminum alloy anodized films formed on the surfaces of the pre-patterned aluminum alloys of Examples 1 to 4, 5 to 8, 9 to 12 and 13 to 16 according to the present invention.

TABLE 2

| | Process modes (Steps 2 to 4) | Contact angle (°) |
|---|---|---|
| Control group | — | 114.8 ± 0.31 |
| Example 1 | MA→PW(30 min)→MA | 136.6 ± 0.58 |
| Example 2 | MA→PW(30 min)→HA | 139.8 ± 0.24 |
| Example 3 | HA→PW(30 min)→MA | 149.2 ± 1.35 |
| Example 4 | HA→PW(30 min)→HA | 150.7 ± 0.58 |
| Example 5 | MA→PW(40 min)→MA | 162.8 ± 1.45 |
| Example 6 | MA→PW(40 min)→HA | 162.0 ± 2.04 |
| Example 7 | HA→PW(40 min)→MA | 149.2 ± 0.78 |
| Example 8 | HA→PW(40 min)→HA | 148.5 ± 0.79 |
| Example 9 | MA→PW(50 min)→MA | 140.7 ± 0.57 |
| Example 10 | MA→PW(50 min)→HA | 142.1 ± 0.55 |
| Example 11 | HA→PW(50 min)→MA | 161.7 ± 0.56 |
| Example 12 | HA→PW(50 min)→HA | 164.4 ± 1.45 |
| Example 13 | MA→PW(60 min)→MA | 122.7 ± 0.88 |
| Example 14 | MA→PW(60 min)→HA | 126.1 ± 0.27 |
| Example 15 | HA→PW(60 min)→MA | 152.0 ± 4.20 |
| Example 16 | HA→PW(60 min)→HA | 170.4 ± 0.05 |
| Comparative Example 1 | SA→PW(30 min)→SA (SA: 80 V, 30 sec) | 139.9 ± 0.31 |
| Comparative Example 2 | SA→PW(30 min)→SA (SA: 100 V, 5 sec) | 135.2 ± 0.35 |

TABLE 2-continued

| | Process modes (Steps 2 to 4) | Contact angle (°) |
|---|---|---|
| Comparative Example 3 | SA→PW(30 min)→SA (SA: 120 V, 30 sec) | 132.6 ± 1.35 |
| Comparative Example 4 | SA→PW(30 min)→SA (SA: 120 V, 4 sec) | 130.4 ± 0.24 |

As shown in Table 2 above and FIGS. 5 to 8, it is confirmed that the wettability to water is lower when coating FDTS, which is a material having low surface energy, on the porous aluminum alloy anodized films of Examples 1 to 16 manufactured through the MA and HA mode control and pore widening process in the secondary and tertiary anodization processes than when coating FDTS on a non-anodized aluminum alloy base material (control group).

On the other hand, although it is found that the porous aluminum alloy anodized films of Comparative Examples 1 to 4 manufactured by performing the secondary and tertiary anodization processes at higher voltages have lower wettability than non-anodized aluminum alloys, it is generally found that the porous aluminum alloy anodized films except for some Comparative Examples of the present invention have higher wettability than the porous aluminum alloy anodized films of Examples 1 to 16 according to the present invention.

Furthermore, as surfaces in which FTDS is coated on the porous aluminum alloy anodized films of Examples 4, 11, 12, 13, 15, and 16 are found to have contact angles of 150° or more, it is indicated that the wettability to water of the surfaces is lower than that of the porous aluminum alloy anodized films of other Comparative Examples and Examples, and it is confirmed that the porous aluminum alloy anodized films of Examples 12 and 16 among them exhibit excellent superhydrophobicity (super water repellency). In particular, the surface in which FTDS is coated on the porous aluminum alloy anodized film of Example 16 manufactured in the order of HA→PW (60 min)→HA exhibits the most excellent superhydrophobicity, and shows a contact angle of 170° or more to confirm that ultra-superhydrophobicity has been implemented.

These results imply that the control of the pore diameter and the interpore distance through the HA (80 V) mode and MA (40 V) mode control in the secondary and tertiary anodization processes affects the wettability to water, and it is confirmed that the secondary and tertiary anodizing conditions (HA) used to manufacture the porous aluminum alloy anodized film of Example 16 having a pillar-on-pore structure according to the present invention are optimal conditions for realizing superhydrophobicity.

So far, the present invention has been focused on its preferred embodiments. A person with ordinary skill in the art to which the present invention pertains will be able to understand that the present invention may be implemented in a modified form within the range that does not depart from the essential features of the present invention. Therefore, the disclosed examples should be considered from an explanatory perspective rather than a limited perspective. The scope of the present invention is shown in the patent claims rather than the foregoing description, and all differences within the scope equivalent thereto should be construed as being included in the present invention.

INDUSTRIAL APPLICABILITY

As an aluminum alloy with a controlled anodized film structure manufactured by a method according to the present invention has excellent superhydrophobicity, corrosion resistance, and thermal conductivity, it may be used in various industrial fields such as electronic device housings, LED lighting covers, heat exchangers, pipes, road structures, automobiles, aircrafts, ships, and generators.

The invention claimed is:

1. A method for manufacturing an 5000 series aluminum alloy anodized film having a superhydrophobic surface with a POP (pillar-on-pore) structure, the method including:

(1) a pre-patterning step of removing a primary anodized film by performing an etching process after primarily anodizing an 5000 series aluminum alloy at 30 to 50 V for 5 to 15 hours;

(2) a step of secondarily anodizing the 5000 series aluminum alloy of the step (1) at 75-85V for 25-35 seconds;

(3) a step of pore-widening, immersing the 5000 series aluminum alloy of the step (2) in a 0.05 to 1.0 M phosphoric acid ($H_3PO_4$) solution for 55 to 65 minutes; and (4) a step of thirdly anodizing the 5000 series aluminum alloy of the step (3) at 75-85V for 25-35 seconds; and (5) a step of hydrophobic coating, coating the 5000 series aluminum alloy of the step (4) with a hydrophobic coating agent capable of SAM (self-assembled monolayer) coating.

2. The method of claim 1, wherein the hydrophobic coating agent capable of SAM (self-assembled monolayer) coating of step (5) is 1H,1H,2H,2H-perfluorodecyltrichlorosilane (FDTS).

3. The method of claim 1, wherein the 5000 series aluminum alloys are one or more selected from the group consisting of Al 5005, Al 5023, Al 5042, Al 5052, Al 5054, Al 5056, Al 5082, Al 5083, Al 5084, Al 5086, Al 5154, Al 5182, Al 5252, Al 5352, Al 5383, Al 5454, Al 5456, Al 5457, Al 5657, and Al 5754.

4. A method for manufacturing an 5000 series aluminum alloy anodized film having POP (pillar-on-pore) structure, the method comprising including:

(1) a pre-patterning step of removing a primary anodized film by performing an etching process after primarily anodizing an 5000 series aluminum alloy at 30 to 50 V for 5 to 15 hours;

(2) a step (step 2) of secondarily anodizing the 5000 series aluminum alloy for which pre patterning has been completed in of the step (1) at 75-85V for 25-35 seconds;

(3) a step of pore-widening, immersing the 5000 series aluminum alloy of the step (2) in a 0.05 to 10 M phosphoric acid ($H_3PO_4$) solution for 55 to 65 minutes; and (4) a step of thirdly anodizing the 5000 series aluminum alloy of the step (3) at 75-85 V for 25-35 seconds.

* * * * *